US007921994B2

(12) United States Patent
Lee et al.

(10) Patent No.: US 7,921,994 B2
(45) Date of Patent: Apr. 12, 2011

(54) PACKAGE FOR SALE, STORAGE AND APPLICATION OF TWO-PART COATINGS

(75) Inventors: Thomas R. Lee, Mission Viejo, CA (US); Duberney Ospina, Tustin, CA (US)

(73) Assignee: Behr Procress Corporation, Santa Ana, CA (US)

( * ) Notice: Subject to any disclaimer, the term of this patent is extended or adjusted under 35 U.S.C. 154(b) by 0 days.

(21) Appl. No.: 11/666,514

(22) PCT Filed: Oct. 25, 2005

(86) PCT No.: PCT/US2005/038442

§ 371 (c)(1),
(2), (4) Date: Sep. 22, 2008

(87) PCT Pub. No.: WO2006/049971

PCT Pub. Date: May 11, 2006

(65) Prior Publication Data

US 2009/0032538 A1 Feb. 5, 2009

(51) Int. Cl.
*B65D 69/00* (2006.01)
*B65D 71/00* (2006.01)

(52) U.S. Cl. ..... 206/229; 206/223; 206/1.8; 206/1.9; 206/361; 206/362; 220/555; 220/526; 220/525; 220/570; 220/736

(58) Field of Classification Search ..... 206/1.8, 206/1.9, 209, 361, 223, 362, 81, 229; 220/495.02, 220/369, 570, 555, 553, 736, 526, 735, 525
See application file for complete search history.

(56) References Cited

U.S. PATENT DOCUMENTS

| | | | | |
|---|---|---|---|---|
| 2,473,532 A | | 6/1949 | Lazare | |
| 2,741,048 A | * | 4/1956 | Shelton | 206/1.7 |
| 3,576,252 A | | 4/1971 | Conolly | |
| 4,762,224 A | | 8/1988 | Hall | |
| 4,893,723 A | | 1/1990 | Seabolt | |

(Continued)

FOREIGN PATENT DOCUMENTS

EP 0426401 A2 5/1991

(Continued)

OTHER PUBLICATIONS

European Search Report for EP Patent 05811828.2-2304, Dated May 26, 2008.

*Primary Examiner* — J. Gregory Pickett
*Assistant Examiner* — Blaine G Neway
(74) *Attorney, Agent, or Firm* — Reising Ethington PC

(57) ABSTRACT

A package (10) includes a one-piece molded plastic container having a base (14), an outer wall (16), and at least one dividing wall extending across the outer wall to divide the container into at least first and second chambers that are separated from each other by the dividing wall. The container has an open end remote from the base, and a molded plastic lid (12) is provided for receipt over the open end of the container in sealing engagement with the outer wall and the dividing wall. The lid is constructed to seal the chambers from each other and from ambient surrounding the package. In at least one of the chambers, the dividing wall preferably has ribs for engagement by a coating application roller.

11 Claims, 10 Drawing Sheets

U.S. PATENT DOCUMENTS

| | | | | |
|---|---|---|---|---|
| 4,979,645 | A | 12/1990 | Groves | |
| 5,083,674 | A | 1/1992 | Clark | |
| 5,314,061 | A | 5/1994 | Bedrossian | |
| 5,516,562 | A | 5/1996 | Edwards et al. | |
| 5,546,628 | A | 8/1996 | Silvera | |
| 5,676,240 | A | 10/1997 | Cziraky | |
| 5,753,289 | A | 5/1998 | Ness | |
| 5,966,772 | A | 10/1999 | Woodnorth et al. | |
| 6,062,389 | A | 5/2000 | Kent | |
| 6,098,805 | A | 8/2000 | Kent | |
| 6,105,813 | A | 8/2000 | Abbey | |
| 6,199,718 | B1 | 3/2001 | Ellis | |
| 6,386,386 | B1 | 5/2002 | George | |
| 6,520,335 | B2 | 2/2003 | Moran et al. | |
| 6,571,972 | B1 | 6/2003 | Bouc et al. | |
| 6,596,328 | B1 * | 7/2003 | Bezek et al. | 426/115 |
| 6,604,645 | B1 * | 8/2003 | Vaupotic | 220/212 |
| 7,090,072 | B1 * | 8/2006 | Elliott | 206/15.3 |
| 2001/0035416 | A1 | 11/2001 | Dodson | |
| 2002/0059688 | A1 | 5/2002 | Wakat et al. | |
| 2002/0096525 | A1 | 7/2002 | Bertoldo et al. | |
| 2002/0096527 | A1 | 7/2002 | Arenas et al. | |
| 2002/0112984 | A1 | 8/2002 | Moran et al. | |
| 2003/0006156 | A1 * | 1/2003 | McCracken et al. | 206/373 |
| 2004/0195248 | A1 | 10/2004 | Garcia | |
| 2004/0226958 | A1 * | 11/2004 | Robellard et al. | 220/772 |

FOREIGN PATENT DOCUMENTS

| | | |
|---|---|---|
| EP | 1499506 B1 | 9/2007 |
| FR | 2646829 | 11/1990 |
| GB | 933846 | 8/1963 |
| WO | 9903690 | 1/1999 |

* cited by examiner

PACKAGE FOR SALE, STORAGE AND APPLICATION OF TWO-PART COATINGS

The present disclosure is directed to application of multi-part coatings, such as two-part epoxy paint, and more particularly to a package for retail display, sale, storage and application of two-part coatings.

BACKGROUND AND SUMMARY OF THE DISCLOSURE

A general object of the present disclosure is to provide a package, including a container and a lid, for retail display, sale, storage and application of multi-part coatings.

A package in accordance with presently preferred embodiments of the disclosure includes a one-piece molded plastic container having a base, an outer wall, and at least one dividing wall extending across the outer wall to divide the container into at least first and second chambers that are separated from each other by the dividing wall. The container has an open end remote from the base, and a molded plastic lid is provided for receipt over the open end of the container. The lid is constructed for sealing engagement with the outer wall and the dividing wall to seal the chambers from each other and from ambient surrounding the package. In at least one of the chambers, the dividing wall preferably has protrusions, such as ribs or beads, for engagement by a coating application roller. One chamber preferably has structure, such as a well on the base of the container, for supporting a package of coating compound such as hardener. The package preferably is marketed with a first coating compound in liquid form in one chamber and a second coating compound in a package engaged by support structure in the other chamber.

In one exemplary embodiment of the disclosure, the container has one dividing wall to separate the container into two generally rectangular chambers. In another exemplary embodiment of the disclosure, the container has a pair of spaced parallel dividing walls that divide the container into three separate chambers. The one-piece molded plastic container preferably is of rectangular construction, with the dividing wall(s) preferably extending along a long dimension of the rectangular construction and a handle pivotally connected to the outer wall for transport of the package. The package preferably is marketed with a liquid component in at least one of the chambers, and the lid preferably has a removable closure overlying the liquid chamber for addition of colorant. The package preferably is marketed with one or more coating application tools in a dry chamber.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
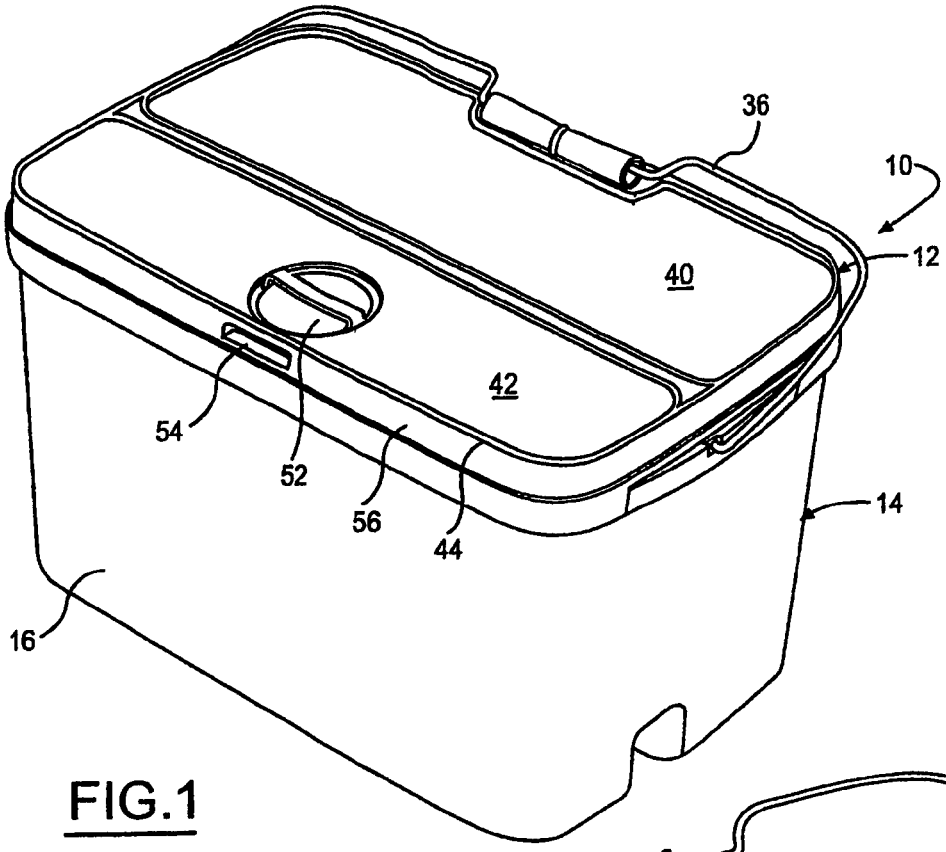
FIG. 1 is a perspective view of a package in accordance with one presently preferred embodiment of the disclosure.
Figure 5:
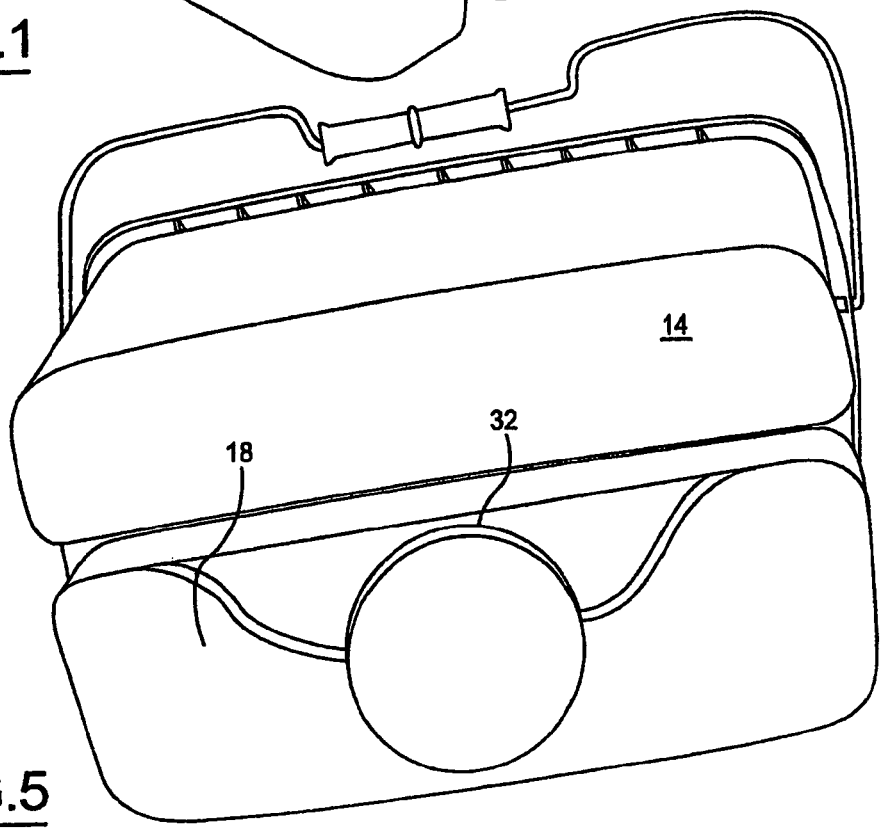
FIG. 5 is a bottom perspective view of the container in the package of FIG. 1.

FIG. 1 illustrates a package 10 in accordance with one presently preferred embodiment of the disclosure as including a lid 12 removably secured to a container 14. Container 14 is illustrated in greater detail in FIGS. 2-5. Container 14 is of one-piece molded plastic construction, preferably substantially rectangular construction, and includes an outer wall 16 that extends entirely around the outside of the container between a base 18 and an open top end. A dividing wall 20 extends across sidewall 18 dividing container 14 into a first compartment or chamber 22 and a second compartment or chamber 24. Chambers 22, 24 are separated and sealed from each other dividing wall 20, which is formed integrally with outer wall 16 and base 18, such as in a thermoforming operation. A plurality of ribs 25 are molded into dividing wall 20, at least within chamber 22 and preferably within both chambers 22, 24. Ribs 25 are in a parallel chevron-shaped array in the illustrated embodiment. Base 18 is in two sections divided by the hollow interior of formed dividing wall 20, as best seen in FIG. 5, and forms a flat base support surface on which container 14 and package 10 can be rested.

The open end of container 14 has a flat shoulder 26 that extends entirely around the perimeter of the container. The upper edge 27 of dividing wall 20 preferably is raised slightly above shoulder 26. Shoulder 26 and edge 27 preferably are parallel to the support plane of base 18. A continuous lip 28 extends upwardly from shoulder 26 and edge 27 entirely around chamber 22. (Directional words such as "upwardly," "top" and "bottom" are employed by way of description and not limitation with respect to the upright orientation of the container and package illustrated in FIGS. 1-4.) Likewise, a continuous lip 30 extends upwardly from shoulder 26 and edge 27 entirely around chamber 24. Lips 28, 30 cooperate with lid 12 (FIGS. 1 and 5) to seal chambers 22, 24 from each other and from the surrounding atmosphere, as will be described. A well 32 (FIGS. 2-3 and 5) is formed on base 18 within chamber 22 for laterally supporting a can 34 containing one of the two coating components. A handle 36 is pivotally mounted on container 14 and extends along a long dimension of the container, generally in the plane of dividing wall 20.

Figure 6:
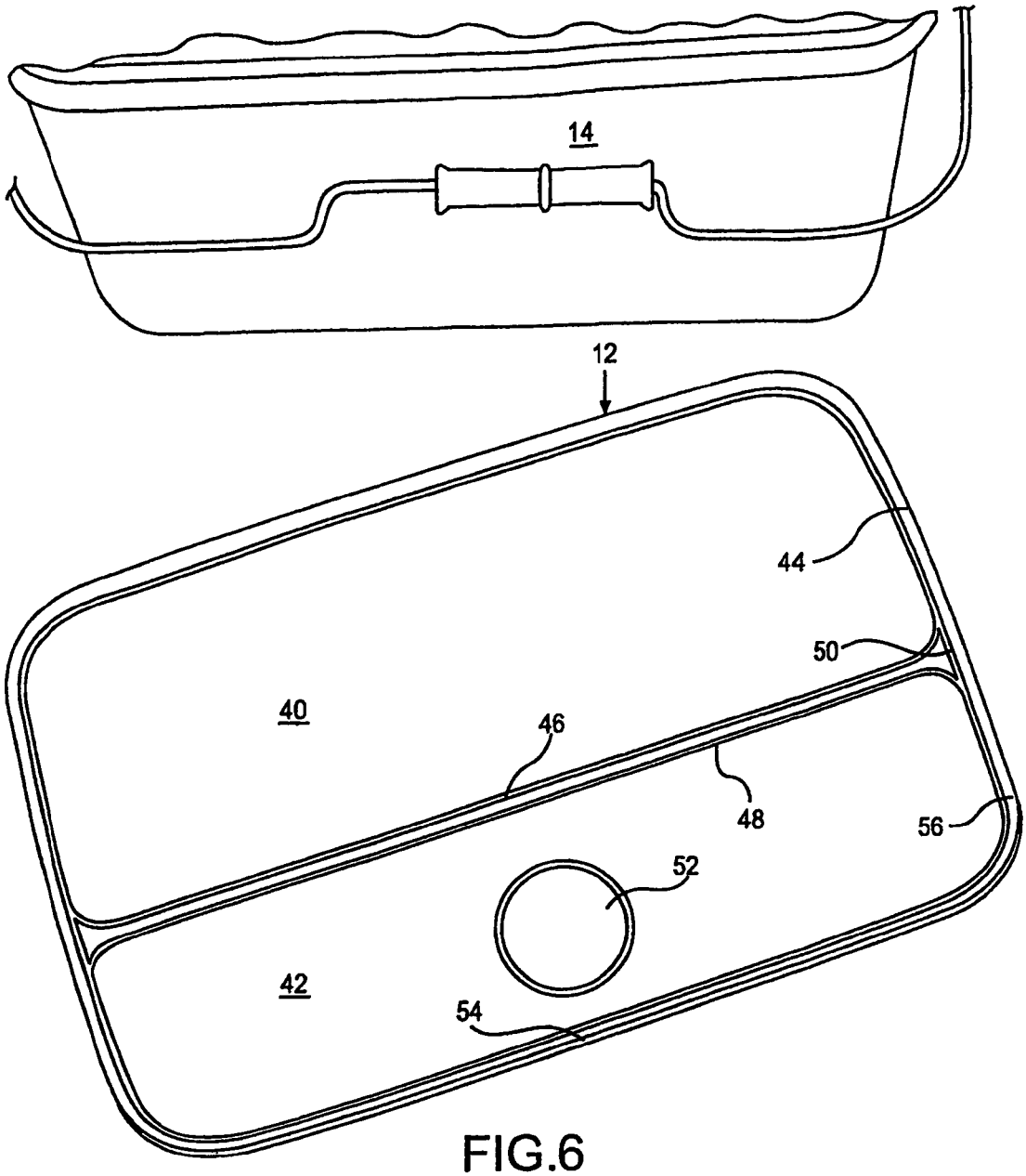
FIG. 6 is a bottom perspective view of the lid in the package of FIG. 1.

Referring to FIGS. 1 and 6, lid 12 has a generally flat body of thermoformed plastic construction. The body of lid 12 is of rectangular geometry corresponding to the geometry of container 14. The lid body has a first generally rectangular portion 40 for overlying chamber 22, a second generally rectangular portion 42 for overlying chamber 24, and a peripheral skirt 44 extending entirely around the body of the lid. A continuous channel is formed between portions 40, 42 and skirt 44. A first continuous seal 46 is disposed in this channel in surrounding engagement with lid portion 40. A second seal 48 is disposed in the channel in surrounding engagement with lid portion 42. A third seal 50 on skirt 44 surrounds both portions 40, 42. In assembly, lips 28, 30 (FIGS. 2 and 3) on container 14 are received between opposed sections of seals 46, 48, 50 (FIG. 6) to seal the package. A closure 52 (FIGS. 1 and 6) is removably secured to lid 12 in a position to overlie and be in alignment with chamber 24 for adding tint or colorant to the liquid component within chamber 24, as will be described. A tab 54 on the periphery of lid 12 adjacent to closure 46 is connected to a tear band 56, which is molded integrally with lid 12 and extends entirely around the periphery of the lid, to permit removal of the lid by a user.

Figure 2:
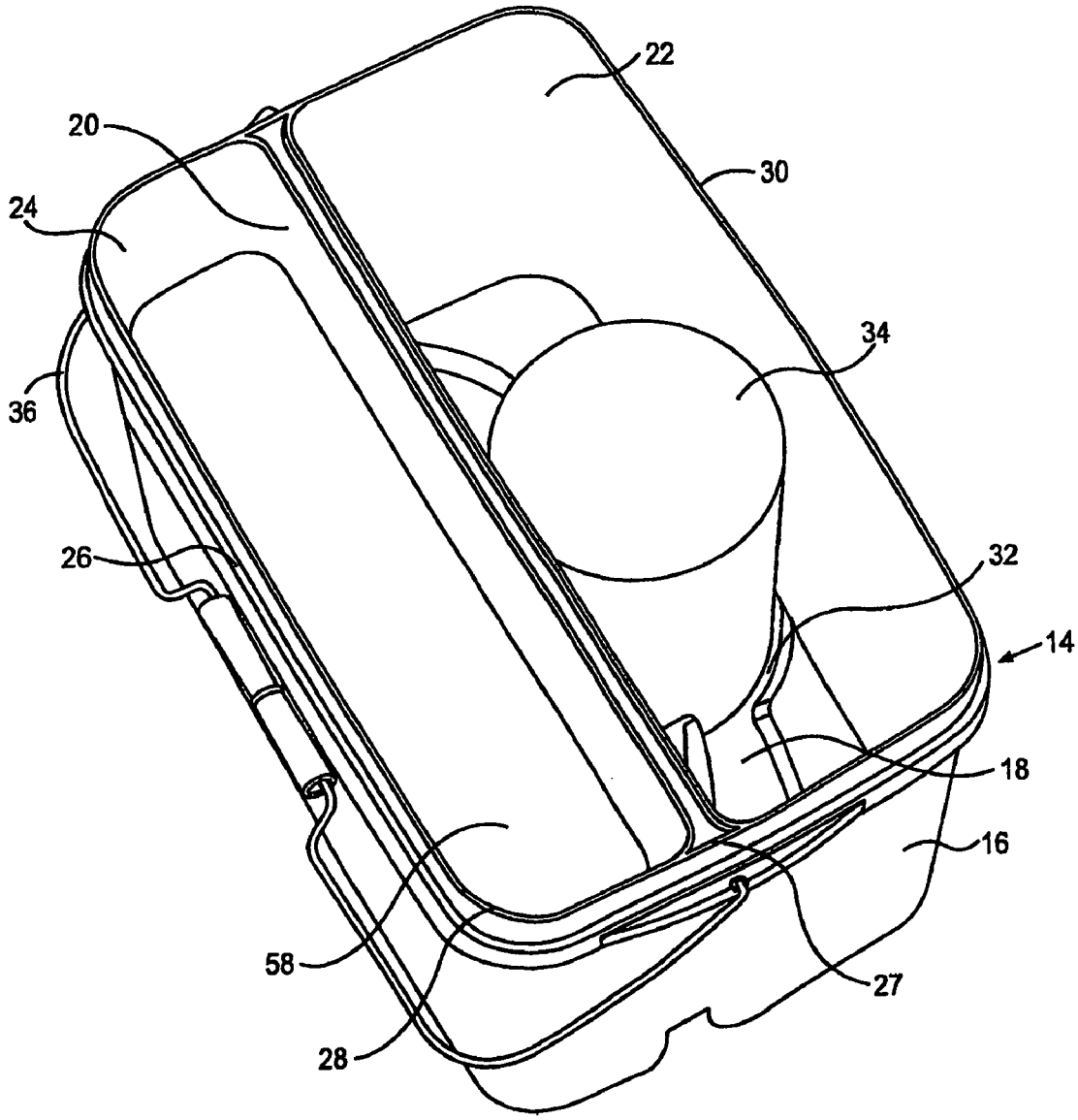
FIG. 2 is a perspective view of the container in the package of FIG. 1 with the lid and the coating application tools removed.
Figure 3:
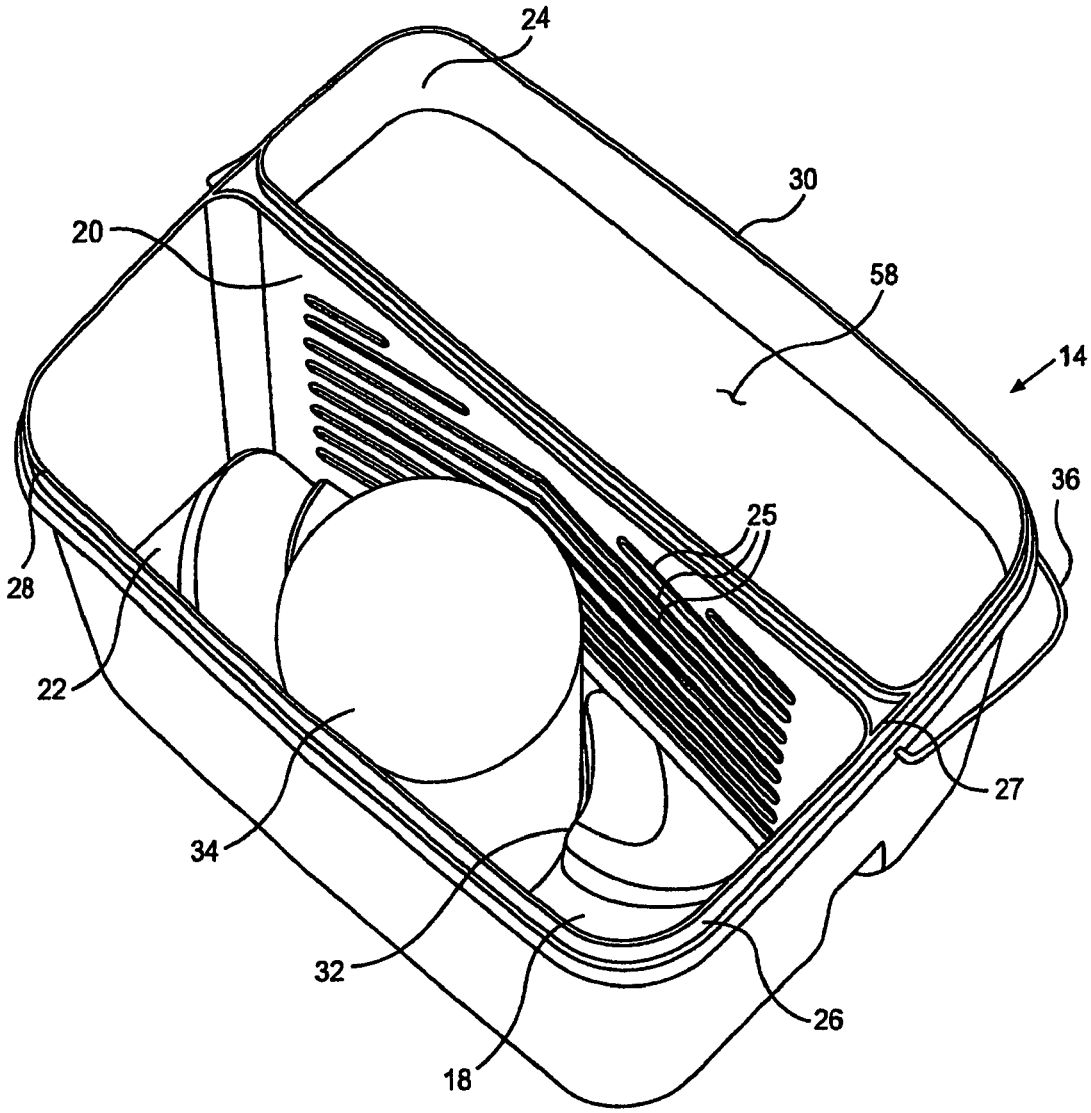
FIG. 3 is an opposing perspective view of the container of FIG. 2.
Figure 4:
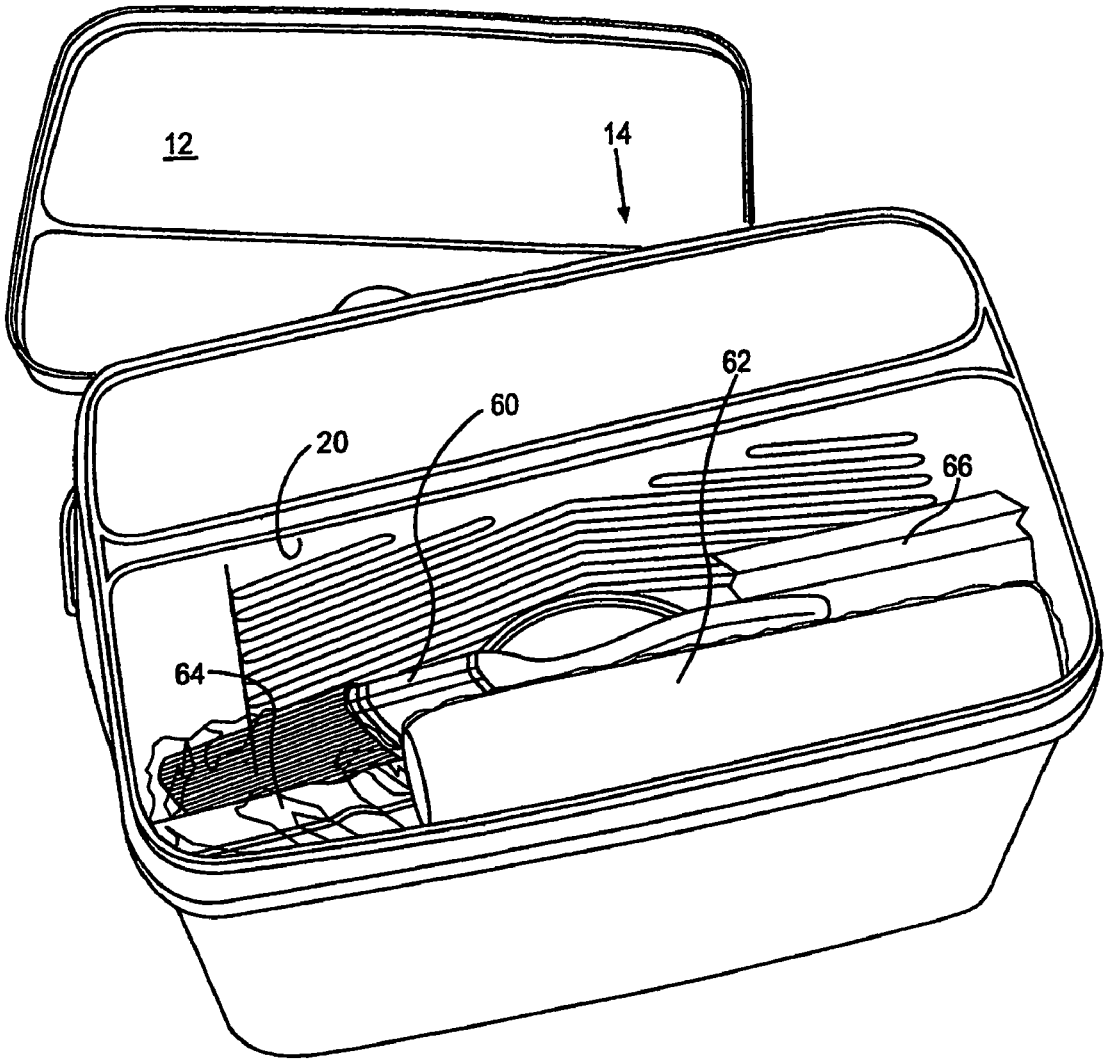
FIG. 4 is a perspective view of the container in FIGS. 1 and 2 with coating application tools placed in the container prior to securement of the lid on the container.

In use, a packager places the liquid component of a two part coating into chamber 24, as at 58 in FIGS. 2 and 3. The second (e.g., hardener) component is placed in can 34, which in turn is placed in well 32 of chamber 22. Dividing wall 20 thus separates "dry" chamber 22 from "wet" chamber 24. One or more coating application tools, such as a brush 60, a roller cover 62, a stirrer 64 and/or a package 66 cleaner/etcher (FIG. 4), preferably are placed by the packager within dry chamber 22. Lid 12 then is located over the open end of container 14 and pressed downwardly so that lips 28,30 are received within seals 46, 48, 50 to seal the package. Suitable labeling can be placed on the upper face of lid 12 and/or one or more of the outer wall surfaces of outer wall 16, either before or after placement of coating components, etc within the container. The package is then ready for shipment to a retailer and display for sale. Well 32 on base 18 restrains can 34 from substantial movement within compartment 22.

At the time of purchase by a customer, closure 52 can be removed from lid 12 to permit addition of a suitable dye or colorant to liquid component 58. The lateral position of handle 36 preferably is such that, with can 34 and compartment 24 full, the package is substantially balanced for easy transport by a customer. When the customer is ready to apply the coating, tear band 56 is removed and lid 12 removed from container 14. Can 34 is opened and the second component added to liquid component 58. The two-part coating is then ready for application. Ribs 25 on dividing wall 20 within dry-side chamber 22 can be engaged by the roller to facilitate coating application.

Figure 8:
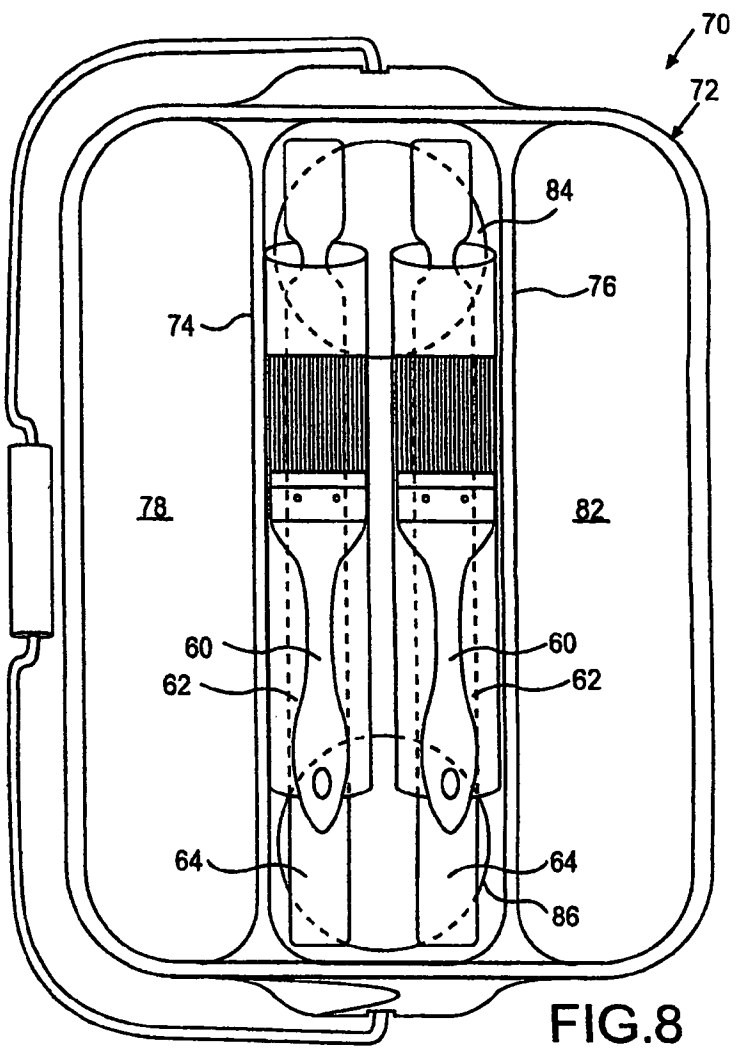
FIGS. 7 and 8 are top plan views of a package with lid removed in accordance with a second presently preferred embodiment of the disclosure.
Figure 7:
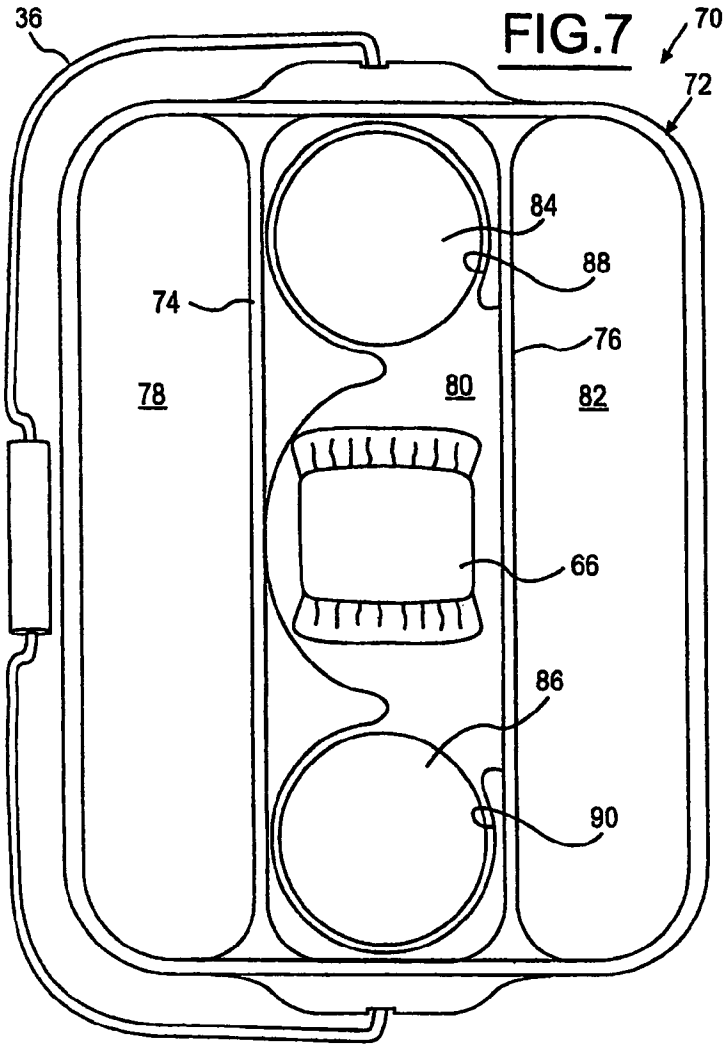
Figure 9:
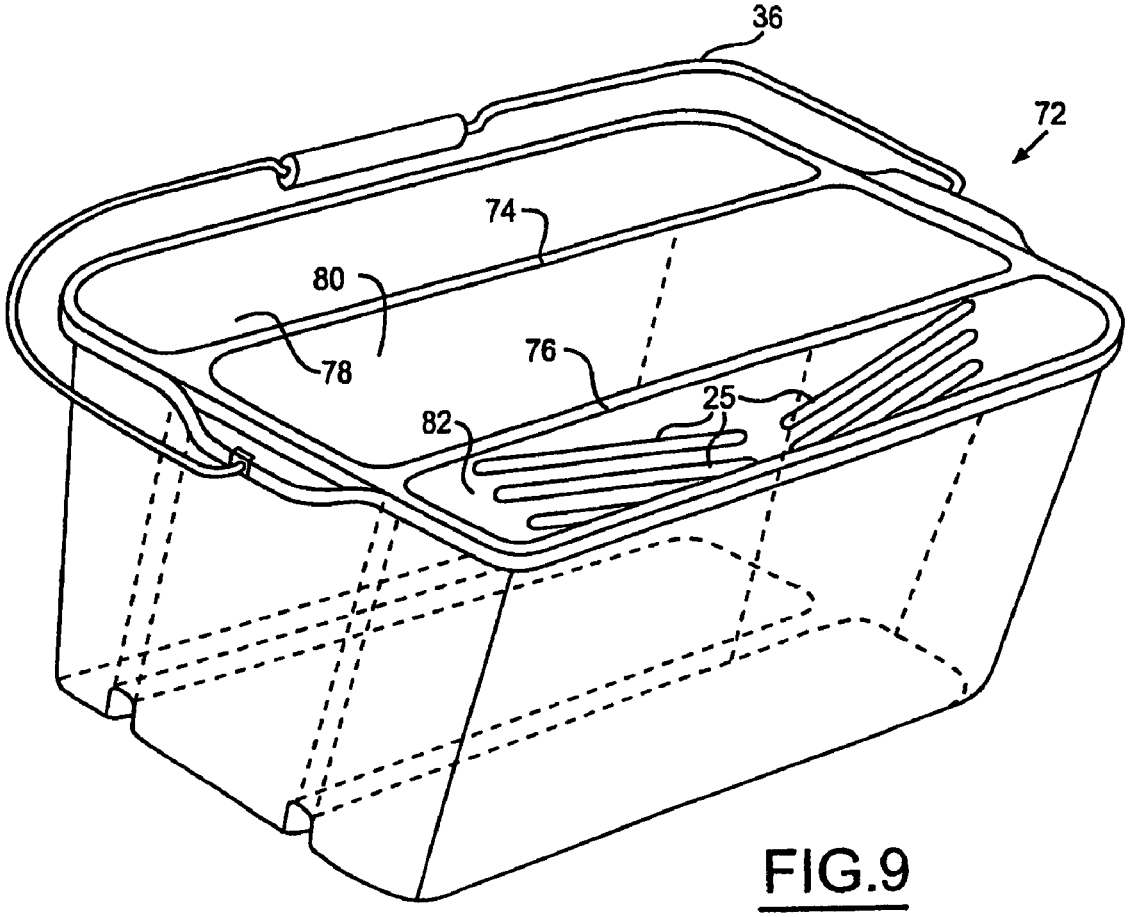
FIG. 9 is a perspective view of the container in the package of FIGS. 7 and 8.

FIGS. 7-9 illustrate a package 70 in accordance with a second embodiment of the disclosure. In package 70, container 72 has spaced parallel dividing walls 74, 76 forming three generally rectangular chambers 78, 80, 82. The outer chambers 78, 82 are filled with liquid coating component. Center chamber 80 preferably holds two cans 84, 86 of hardener in associated wells 88, 90, a package 66 of cleaner/etcher, two roller covers 62, two brushes 60 and two stirrers 64.

Figure 10:
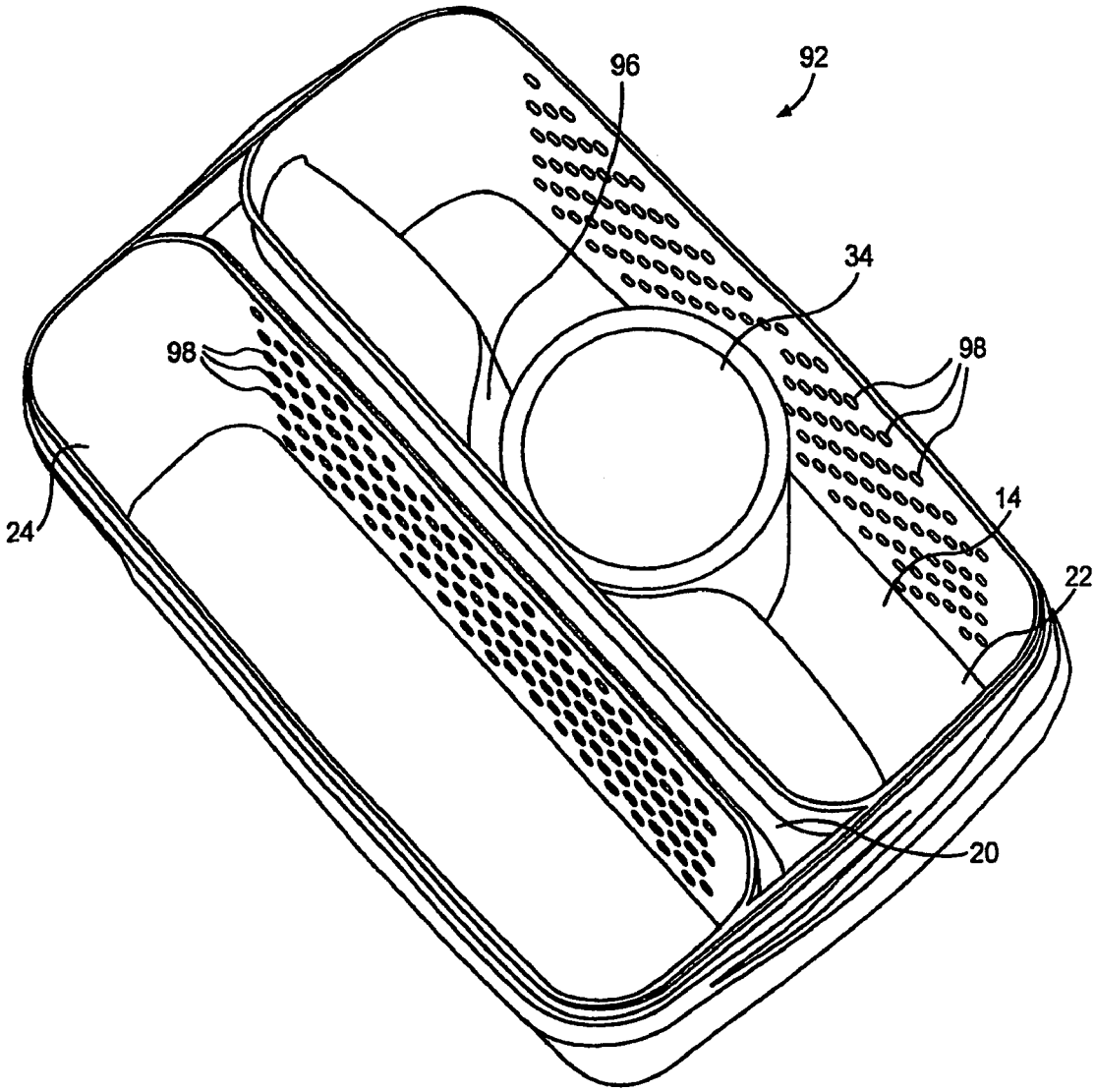
FIG. 10 is a perspective view of a container in accordance with another embodiment of the disclosure.
Figure 11:
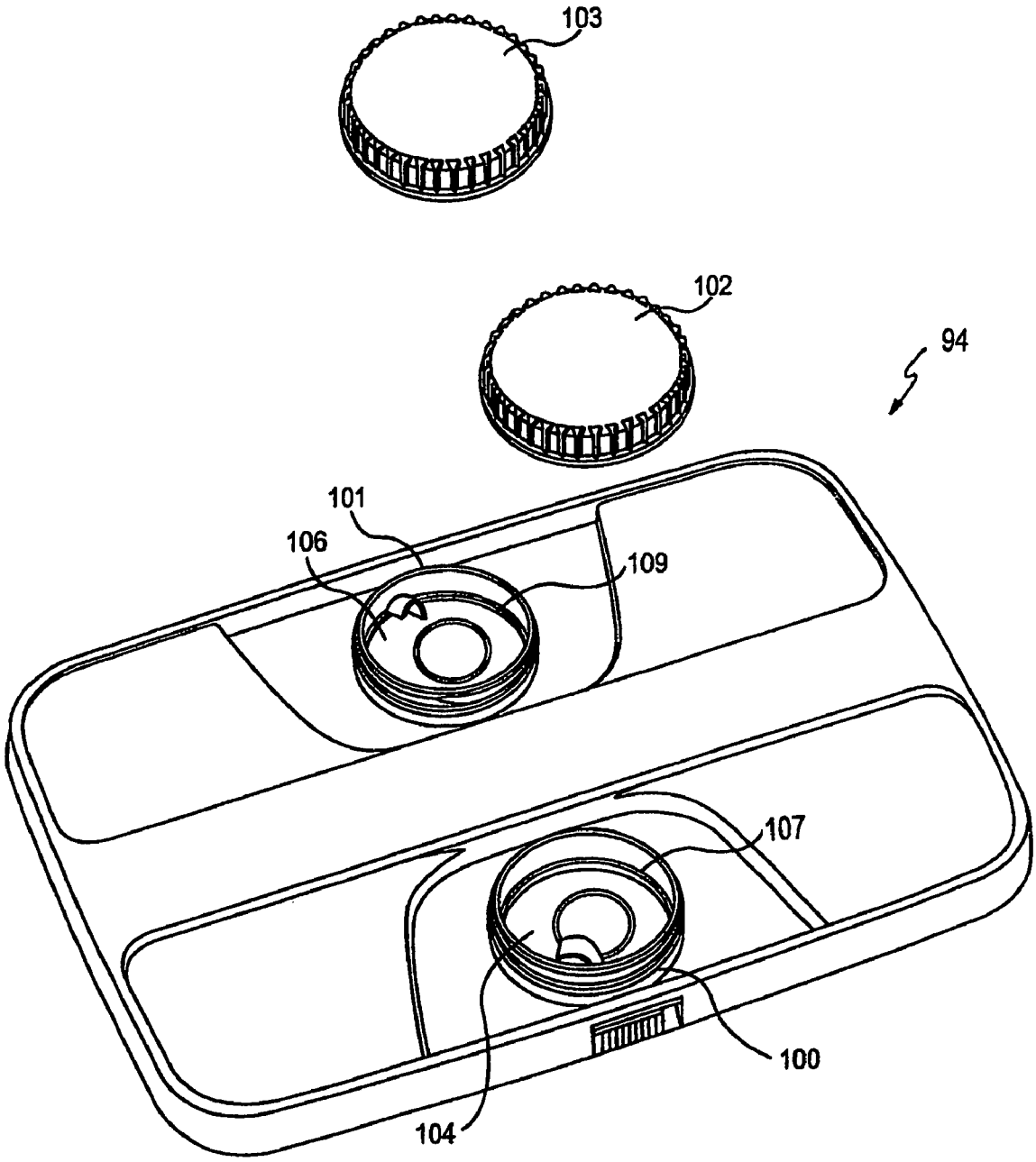
FIG. 11 is an exploded perspective view of a lid or cover for the container of FIG. 10.
Figure 12:
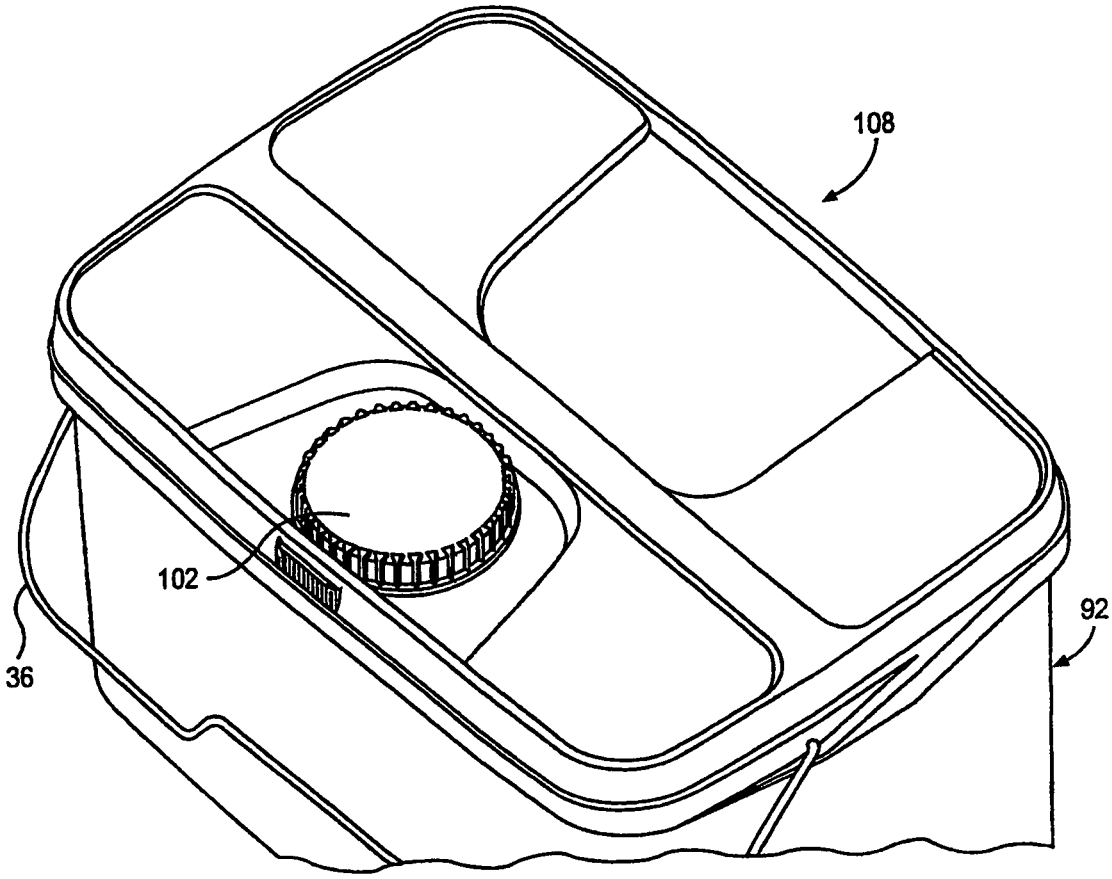
FIG. 12 is a fragmentary perspective view of a package in accordance with a further embodiment of the disclosure.

FIGS. 10 and 11 illustrate a package that includes a container 92 (FIG. 10) and a lid 94 (FIG. 11) in accordance with another embodiment of the disclosure. Container 92 differs from container 14 in FIGS. 1-6 in that the well 96 in the base 14 is deeper than is well 32 in FIGS. 1-6 for more secure holding of can 34. Ribs 25 in FIGS. 1-6 are replaced by raised beads 96 in FIG. 10. Lid 94 in FIG. 11 has a pair of necks 100, 101 with external threads for receiving internally threaded closure 102, 103. Necks 100, 101 overlie chambers 22, 24 of container 92 (FIG. 10) in assembly so that either or both chambers can be used as a liquid chamber. Frangibly removable tear-off seals 104, 106 are disposed within necks 100, 101 and have finger tabs that can be grasped to tear the seals from the lid. Seals 104, 106 are molded integrally with lid 94 and preferably are connected to the insides of necks 100, 101 by respective annular lines of weakness 107, 109. The tear-off seals entirely close the necks until removed. FIG. 12 illustrates a lid 108 with a single opening closed by a closure 102. Lid 108 (which includes a neck 100 and a tear-off seal 104 beneath closure 102) can be used in place of lid 94 (FIG. 11) when through-the-lid access to only one chamber 24 is desired.

There thus has been disclosed a package for multi-part coatings, preferably two-part coatings that fully achieves all of the objects and aims previously set forth. The package has been disclosed in conjunction with two presently preferred embodiments thereof, and a number of modifications and variations have been described. Other modifications and variations readily will suggest themselves to persons of ordinary skill in the art. The disclosure is intended to embrace all such modifications and variations as fall within the spirit and broad scope of the appended claims.

The invention claimed is:

1. A package for retail display, sale, storage and application of a two-part coating, which includes:

a one-piece molded plastic container of substantially rectangular construction and having a base, an outer wall extending around said container, at least one dividing wall extending across said outer wall along a long dimension of said rectangular construction and dividing said container into at least first and second generally rectangular chambers that are separated from each other by said dividing wall, said dividing wall having a hollow interior dividing said base into two sections and being non-centered within said outer wall such that said first generally rectangular chamber is larger than said second generally rectangular chamber, and an open end remote from said base with a continuous lip extending entirely around said second generally rectangular chamber, a first coating component in a separate can disposed in said first generally rectangular chamber, said first generally rectangular chamber including a well on said base in said first generally rectangular chamber holding and laterally supporting said separate can, an open liquid second coating component in said second generally rectangular chamber, a plastic lid having a peripheral skirt received over said open end of said container, said plastic lid being in sealing engagement with said open end around said outer wall and along said dividing wall, and sealing said chambers from each other and from outside of said package, said plastic lid having a first generally rectangular portion overlying said first generally rectangular chamber of said container and a second generally rectangular portion overlying said second generally rectangular chamber of said container with an opening overlying said second generally rectangular chamber and said second coating component in said second generally rectangular chamber, an integral seal surrounding said second generally rectangular portion and sealed to said continuous lip of said open end of said container, another integral seal surrounding both of said generally rectangular portions and sealed to said continuous lip of said open end of said container, and a tab connected to a tear band depending from said peripheral skirt and extending around the periphery of the lid and being removable to permit removal of said lid from the container, a removable closure that closes said opening in said lid overlying said second generally rectangular chamber for adding colorant to said open liquid second coating component in said second generally rectangular chamber, at least one coating application tool in said first generally rectangular chamber with said can.

2. The package set forth in claim 1 wherein, in at least one of said chambers, said dividing wall has protrusions for engagement by a coating application roller.

3. The package set forth in claim 1 including a neck on said lid surrounding said opening for receiving said closure and a frangibly removable seal integrally molded with said lid within said neck.

4. A package including:

a one-piece molded plastic container of substantially rectangular construction and having a base, an outer wall extending around said container, at least one dividing wall extending across said outer wall along a long dimension of said rectangular construction to divide said container into a first generally rectangular chamber having a well and a second generally rectangular chamber, said dividing wall also having a hollow interior dividing said base into two sections and being non-centered within said outer wall such that said first generally rectangular chamber is larger than said second generally rectangular chamber, and an open end remote from said base with a continuous lip extending entirely around said second generally rectangular chamber, a first coating in liquid form in a separate package laterally supported in said well of said first generally rectangular chamber of said container, at least one coating application tool in said first generally rectangular chamber with said separate package, a second coating in open liquid form in said second generally rectangular chamber of said container, and a plastic lid having a peripheral skirt received over said open end of said container, a first generally rectangular portion overlying said first generally rectangular chamber of said container, a second generally rectangular portion overlying said second generally rectangular chamber of said container, an integral seal surrounding said second generally rectangular portion and sealed to said continuous lip of said open end of said container, another integral seal surrounding both of said generally rectangular portions and sealed to said continuous lip of said open end of said container, and a tab connected to a tear band depending from said peripheral skirt and extending around the periphery of said lid and being removable to permit removal of said lid from said container.

5. The package set forth in claim 4 wherein, in at least one of said chambers, said dividing wall has protrusions for engagement by a coating application roller.

6. The package set forth in claim 4 wherein said second generally rectangular portion of said lid also includes an opening defined by a threaded neck.

7. The package set forth in claim 5, further comprising a threaded closure threaded to said threaded neck of said lid to close said opening in said lid.

8. The package set forth in claim 7, further comprising a seal disposed within said neck and having a finger tab for removal of said seal from said neck.

9. The package set forth in claim 1 wherein said first coating component is a hardener of suitable for being added to said second coating component to form a two-part epoxy paint ready for application.

10. The package set forth in claim 4 wherein said first coating is a hardener of suitable for being added to said second coating to form a two-part epoxy paint ready for application.

11. The package set forth in claim 10 wherein said separate package is a can.

* * * * *